United States Patent [19]

Filisko et al.

[11] Patent Number: 4,744,914

[45] Date of Patent: May 17, 1988

[54] ELECTRIC FIELD DEPENDENT FLUIDS

[75] Inventors: Frank E. Filisko; William E. Armstrong, both of Ann Arbor, Mich.

[73] Assignee: Board of Regents of the University of Michigan, Ann Arbor, Mich.

[21] Appl. No.: 922,003

[22] Filed: Oct. 22, 1986

[51] Int. Cl.[4] ..... H01B 3/20

[52] U.S. Cl. ..... 252/74; 252/572

[58] Field of Search ..... 252/74, 572

[56] References Cited

U.S. PATENT DOCUMENTS

| | | | |
|---|---|---|---|
| 3,047,507 | 7/1962 | Winslow | 252/75 |
| 3,250,726 | 5/1966 | Martinek et al. | 252/74 |
| 3,367,872 | 2/1968 | Martinek et al. | 252/74 |
| 4,033,892 | 7/1977 | Stangroom | 252/76 |
| 4,129,513 | 12/1978 | Stangroom | 252/73 |
| 4,483,788 | 11/1984 | Stangroom et al. | 252/76 |
| 4,502,973 | 3/1985 | Stangroom | 252/73 |

FOREIGN PATENT DOCUMENTS 7817585 2/1978 Japan .

*Primary Examiner*—Robert A. Wax

*Attorney, Agent, or Firm*—Robert B. Stevenson

[57] ABSTRACT

An improved electric field dependent fluid and method of preparing the same for use at temperatures in excess of 100° C. (typically 120° C.) without releasing water comprising: a nonconductive liquid phase; and a dispersed particulate crystalline zeolite phase (e.g., $M_{(x/n)}[AlO_2)_x(SiO_2)_y]\ wH_2O$ where M is a metal cation or mixture of metal cations of average valence charge n, x and y are integers and the ratio of y to x is from about 1 to about 5, and w is a variable). Such field dependent fluids are particularly useful in automotive and/or other high temperatures applications.

8 Claims, 8 Drawing Sheets

ELECTRIC FIELD DEPENDENT FLUIDS

BACKGROUND OF THE INVENTION

1. Field of the Invention

This invention relates to electric field dependent/responsive fluids such as the so-called "electrorheological" or "electroviscous" fluids. More specifically, the invention relates to improved electric field dependent fluids and methods of preparing the same wherein the fluids exhibit a reversible viscosity rise in the presence of high voltage at temperatures in excess of 100 C. without the deleterious release of water. 2. Description of the Prior Art It is generally known that electroviscous or electrorheological fluids exhibit pronounced changes in viscosity and resistance to shear in response to the application of an electric field. Such fluids generally comprises suspensions of finely divided, solid particles which intentionally contain a certain amount of adsorbed water dispersed in a nonconductive, hydrophobic liquid. The presence of the water has been acknowledged as being a critical and mechanistically necessary element in achieving the desired change in viscosity under the influence of an applied electric field. Thus for example U.S. Pat. No. 3,047,507 teaches and claims the addition of excess or adsorbed water as do U.S. Pat. Nos. 4,483,788; 4,033,892 and 4,129,513. In explaining mechanistically the role of adsorbed water it is postulated that the presence of adsorbed water in or on the particulate material is necessary to promote ionization and thus allow changes to move freely on the surface of the particles when an electric field is imposed. However, because of the intentional presence of adsorbed water in the electroviscous fluids of the prior art, such compositions are restricted to low temperature end use applications. In high temperature applications or in high shear rate applications wherein a shear induced exotherm can occur, free water or water vapor will be produced thus representing a potentially corrosive environment, which severely limits these prior art electroviscous fluid systems.

SUMMARY OF THE INVENTION

In view of the problems associated with the prior art electroviscous fluids and in particular the deleterious release of water at high temperatures and/or high shear rates, the present invention provides improved electric field dependent fluids that are operative at temperatures in excess of 100° C. without significant release of water. In this regard the electric field dependent fluids according to the present invention are to be referred to as being substantially free of adsorbed water, and as such appear to be electroviscous by virtue of a mechanism contra to or at least different from that which has been previously proposed. Thus the present invention provides an improved electric field dependent fluid comprising: (a) a nonconductive liquid phase; (b) and a dispersed particulate crystalline zeolite phase, substantially free of adsorbed water.

In a preferred embodiment according to the present invention the crystalline zeolite is characterized by the formula:

$$M_{(x/n)}[(AlO_2)_x(SiO_2)_y].wH_2O \quad (1)$$

where M is a metal cation or mixtures of metal cations of average valence charge n, x and y are integers and the ratio of y to x is from about 1 to about 5, and w is a variable.

The method of preparing a field dependent fluid, adapted to be operative at temperatures in excess of the boiling point of water without the release of water, according to the present invention, comprises the steps of: (a) selecting a nonconductive liquid of the field dependent fluid; (b) selecting a particulate crystalline zeolite of the field dependent fluid; and (c) subjecting the nonconductive liquid and the particulate crystalline zeolite to a temperature in excess of the temperature to which the field dependent fluid will be subjected to during use for a sufficient time to degas and remove water.

In a particularly preferred embodiment of the method according to the present invention, the crystalline zeolite is as previously described in formula (1) and further comprising the step of combining the nonconductive fluid with the particulate crystalline zeolite before subjecting the combination to a temperature in excess of the temperature to which the field dependent fluid will be subjected to during use for sufficient time to degas and remove water from the combination. Typically the degassing and removal of water is accomplished under vacuum at temperatures from about 250° C. to about 350° C.

It is an object of the present invention to provide electric field dependent fluids that are substantially free of adsorbed water and as such do not release deliterious amounts of water at high temperatures. It is a further object to provide a method of preparing such electric field dependent fluids that ensures the absence of release of water at high temperatures. And it is an object of the present invention to provide electric field dependent fluids which will retain their electric field dependency at temperatures well above 100 C. without significant evolution of water, and which will remain functional at high shear rates. Fulfillment of these objects and the presence and fulfillment of additional objects will be apparent upon complete reading of the specifications and claims taken in conjunction with the attached drawings.

DESCRIPTION OF THE PREFERRED EMBODIMENTS

Figure 1:
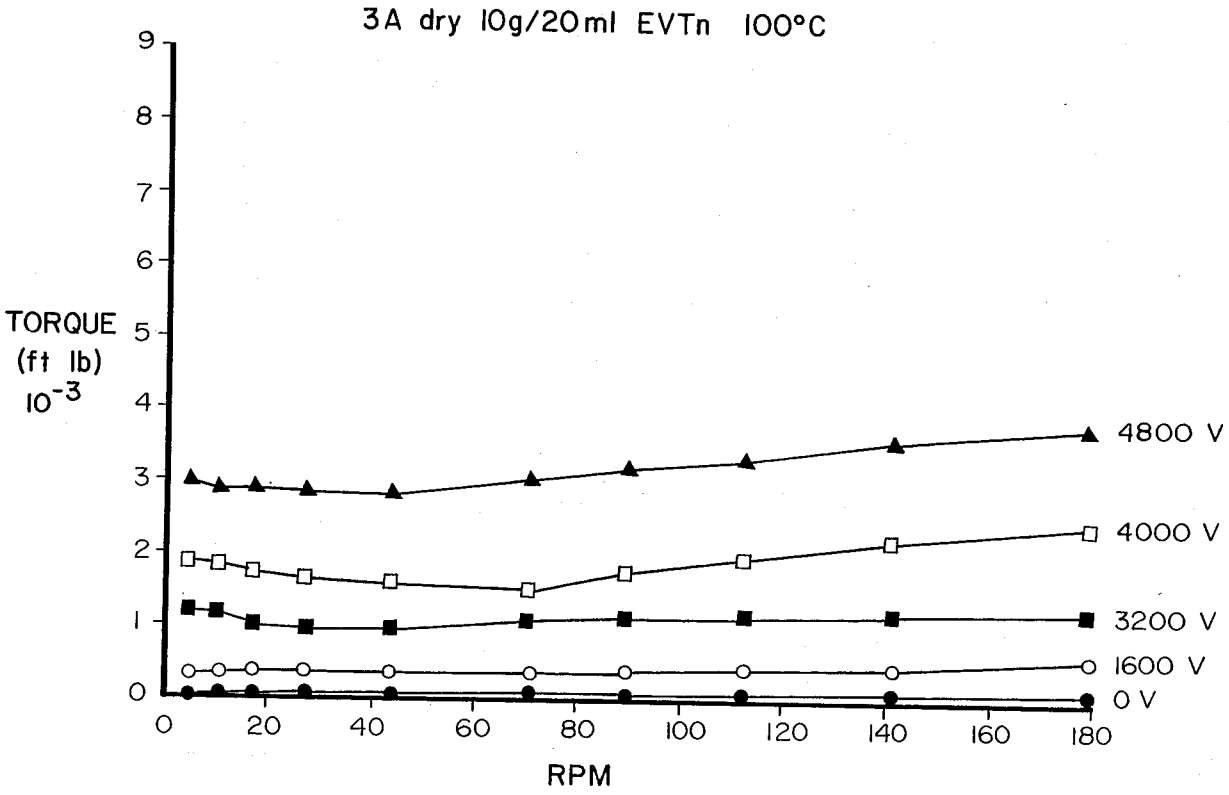
FIGS. 1 through 8 represent plots of transmitted torque as a function of rpm at various applied electric field strengths for a series of electric field dependent fluids according to the present invention.

The improved electric field dependent fluids according to the present invention are essentially two component systems in that they are comprised of a nonconductive liquid phase and a dispersed crystalline zeolite phase or more specifically a crystalline aluminosilicate phase which is substantially free of adsorbed water. In other words, the composition of the present invention, in contrast to the prior art compositions, involves a dispersed particulate solid phase in a nonconductive liquid wherein the dispersed particulate solid phase is intentionally dried prior to use, even though the prior art teaches that adsorbed water on the dispersed particulate phase is critical and mechanistically necessary to achieve electroviscous behavior.

The liquid phase employed in the electric field dependent fluids according to the present invention can generally be any nonconductive substance or material that exists in a liquid phase at the end use condition to which the fluid is to be employed. As such the liquid phase selected for use in the field dependent fluids according to the present invention can be solids, waxes or the like at room temperatures provided they become liquids under the operating conditions of the end use application and as such are to be considered to be within the scope of the phrase "nonconductive liquid" for purposes of this invention. Any such substance as generally known in the art can be selected as the nonconductive liquid phase including by way of example but not limited thereto: silicone fluids, greases and waxes; various hydrocarbons, including petroleum fractions, greases, waxes, polymers, high dielectric oils, transformer oils, and similar petrochemicals or the like. The preferred liquid phase materials are the silicone fluids and/or the high dielectric hydrocarbon oils. Preferably the selection of the liquid phase is based on low affinity for water (hydrophobicity), low viscosity and maximum dielectric strength.

The particulate phase to be dispersed in the nonconductive liquid phase according to the present invention can generally be any substance that categorically is characterized as a crystalline zeolite. As such, any composition which contains significant crystalline aluminosilicate structure is viewed as being operative for purposes of this invention. Thus natural zeolites as well as synthetic zeolites having significant crystallinity in contrast to being amorphous, will exhibit the desired high temperature electric field dependent properties of the present invention. The crystalline zeolites according to the present invention are to be used in a dry state or more specifically are to be substantially free of adsorbed water. Preferably they are to be dried at a temperature equal to or in excess of the temperatures characteristic of the intended end use. In this manner the release or evolution of water during use does not take place and the deleterious effects of water (i.e., changing the dielectric strength of the system and corrosion) do not occur.

One particularly preferred system of particles which, when dispersed into any appropriate nonconductive dielectric fluid, will result in a field dependent fluid which is stable at temperatures in excess of 100 C. and at least as high as 120 C. are the crystalline aluminosilicates of the general formula:

$$M_{(x/n)}[(AlO_2)_x(SiO_2)_y].wH_2O$$

where M is a metal cation or mixtures of metal cations of average valence charge n, x and y are integers and the ratio of y to x is from about 1 to about 5, and w is a variable.

The effectiveness of these particles in field dependent fluids varies with the type or types and amounts of cations, more specifically the relative amounts of Si and Al, and their structures. These particles have enormous surface areas due to a unique porous nature which consists of various cavities interconnected by channels. The size of the cavities and channels are controllable synthetically and very important in the effectiveness of the particles. As such, these particles are previously known as molecular sieves and as chemically specific catalyst supports. However, these prior art uses appear to be based mechanistically on the pore size of the molecular sieve which by itself cannot explain the extraordinary field dependent properties of the present invention. Similarly, the adsorbed water mechanism proposed in the prior art associated with the particles of the previously known field dependent fluid cannot, in principle, explain the phenomenon discovered in the present invention. Because the adsorbed water in the molecular sieve compositions is known to be readily removable, presumably the drying of the particulate phase according to the present invention results in a system substantially free of adsorbed water (consistent with the lack of evolution of water at high temperatures and high shear).

Although the mechanism of the electric field dependent fluids according to the present invention is not known for certain and as such the present invention should not be viewed as being unduly limiting relative to any one explanation or rationalization and although there may be some residual water content in the particle phase as explicitly acknowledged in the above formula (1), there is still another possible explanation of mechanistically what is occurring in the use of cystalline zeolites substantially free of adsorbed water. As previously mentioned, the properties of molecular sieves of the above formula (1) are dependent on the relative amount of aluminum incorporated into the crystal lattice. For each aluminum incorporated into the lattice an additional negative charge is introduced requiring the presence of a metal cation associated with the crystalline structure to preserve electrical neutrality. Thus the cations of the crystalline aluminosilicate structure are not linked (covalently bonded) into the crystal structure but are instead free to migrate about the surface specifically under the influence of an electric field. Again without unduly limiting the present inventon, it is felt that the present invention represents the discovery of a totally different, unique and unexpected mechanism for achieving electric field dependent properties for particles dispersed in dielectric liquids. Most importantly, these materials retain their field dependent properties well above 100° C. and even after being stored at 250° C. for months. This allows the fluids to be used in high shear applications where large heats may be generated due to shear heating and in application where such fluids may be exposed to high temperatures.

In order to ensure the lack of significant evolution and release of water high temperatures and high shear rates, the electric field dependent fluids according to the present invention should be dried or otherwise maintained in an essentially water free or at least low water state. Preferably this is accomplished by drying and degassing the electric field dependent fluid, or the selected liquid phase and particulate crystalline zeolite phase used to prepare the fluid. This drying and/or degassing can be accomplished by any method generally known and used in the art for such purposes. This would include by way of example, but is not limited to, heating, heating in a vacuum, desiccating, desiccating in a vacuum or the like. Preferably the drying and degassing of the fluids are accomplished by heating the fluids to a temperature in excess of the anticipated end use temperature under vacuum thus removing water and water vapor in both phases of the fluid. Preferably when drying the particulate crystalline zeolite phase the solid is maintained at an elevated temperature, with or without vacuum, for a substantial period of time. Preferably the temperature employed is well above 100 C., such as 250 C. up to 350 C. or even higher provided the particular crystalline structure is stable and does not collapse at the higher temperature. Storage of the particulate solid phase at about 250 C. for sustained periods of time (e.g. months) is usually quite effective in maintaining the desired low water content in the crystalline zeolite structure without deleteriouly affecting the electric field dependent properties.

In order to demonstrate and confirm the desired electric field dependent properties of the fluids according to the present invention, the transmitted torque as a function of rpm was measured and recorded using a Weisenberg Rheogoniometer. The measurements were made at high temperatures (e.g. 100 C. and 120 C.) under high shear rate conditions (e.g. up to 225 rpm) at various applied electric field strengths (up to 5600 volts d.c.) for a series of selected fluids. In each case the torque transmitted to a stationery cylindrical bob, having a one inch diameter that was concentrically surrounded by a revolving cylindrical cup having a one inch height and 0.050 inch annular spacing between the cup and bob, was measured while the rpm of the revolving cup was varied. Using the cup and the bob as electrodes, various d.c. electrical potentials were imposed across the spacing between the cup and bob which, in turn, was occupied by the selected electric field dependent fluid prepared according to the present invention.

Figure 2:
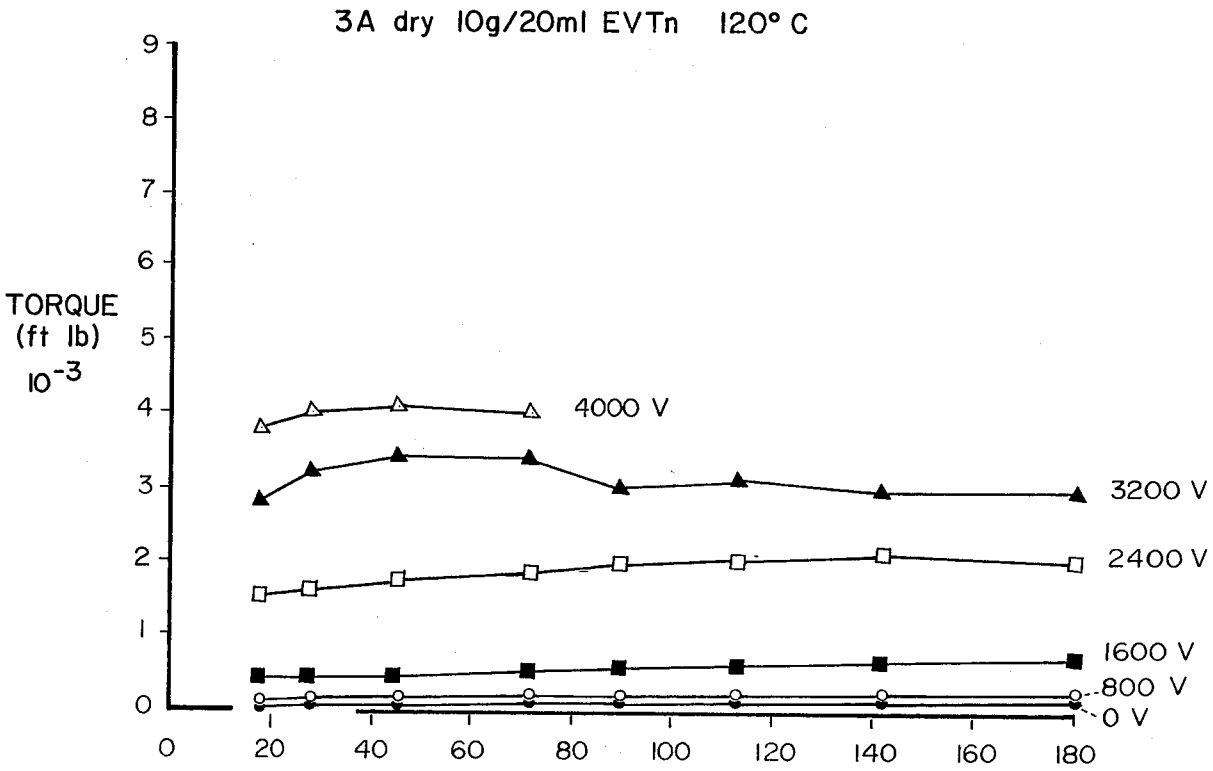
Figure 3:
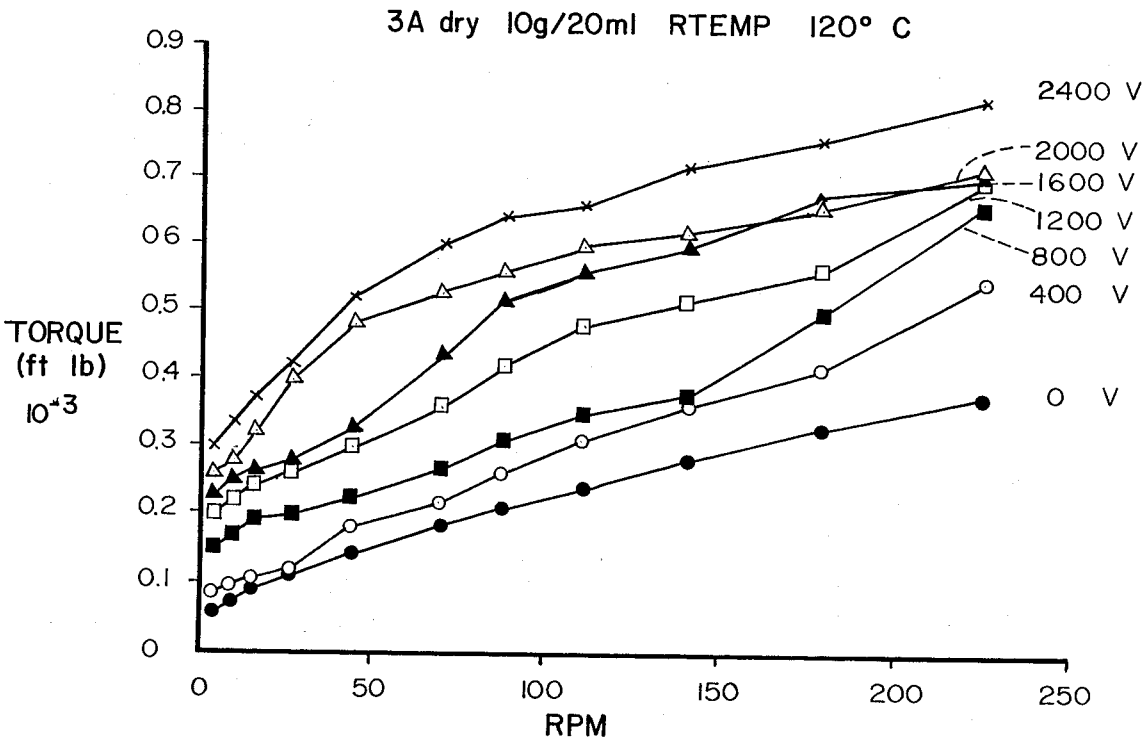
Figure 4:
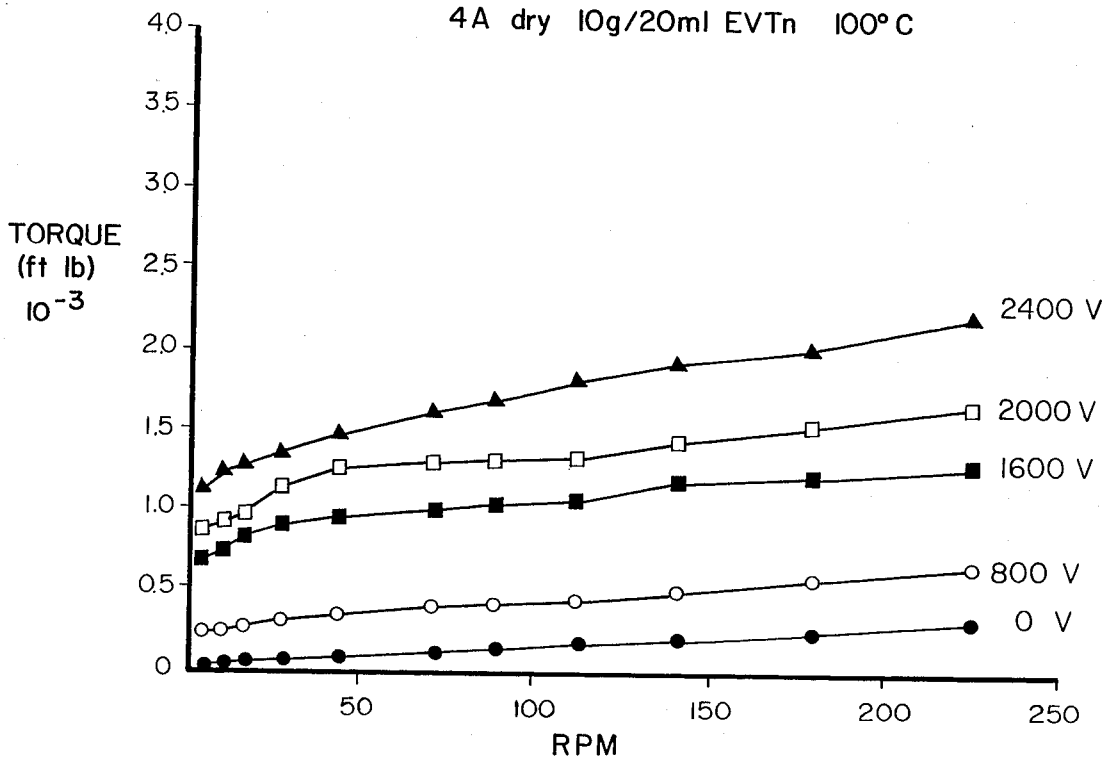
Figure 5:
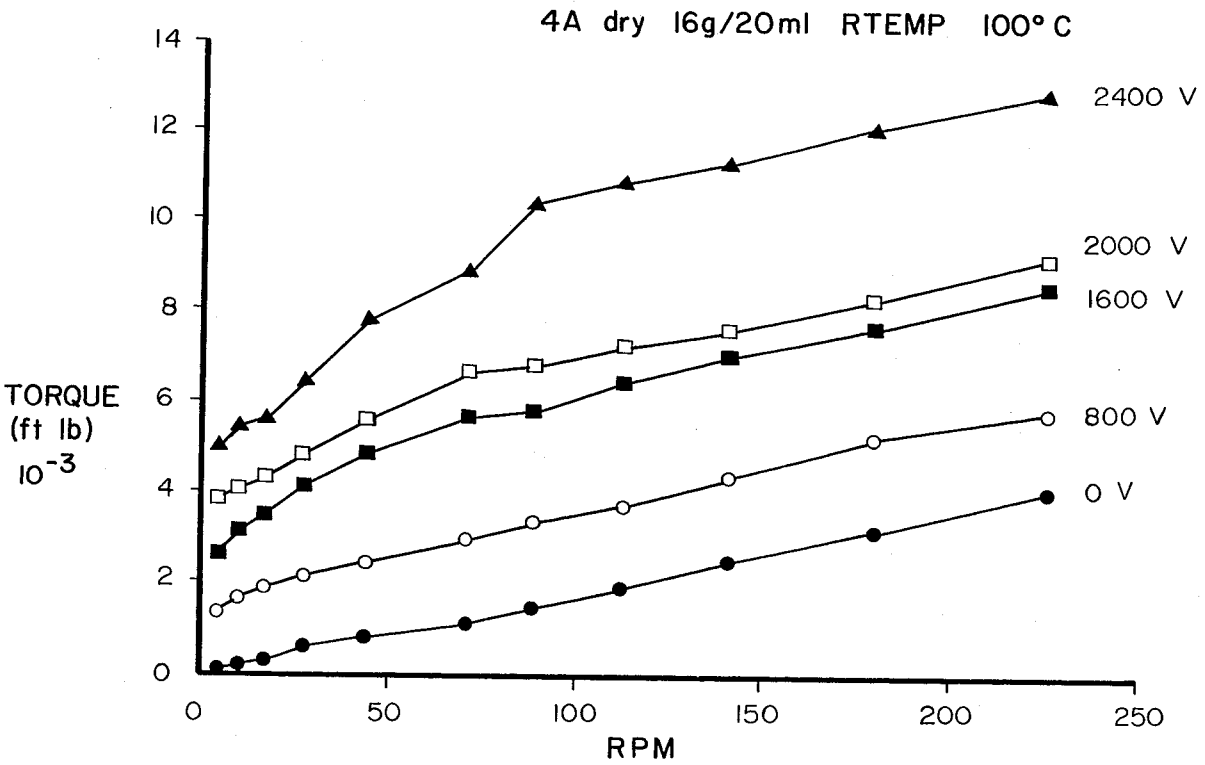
Figure 6:
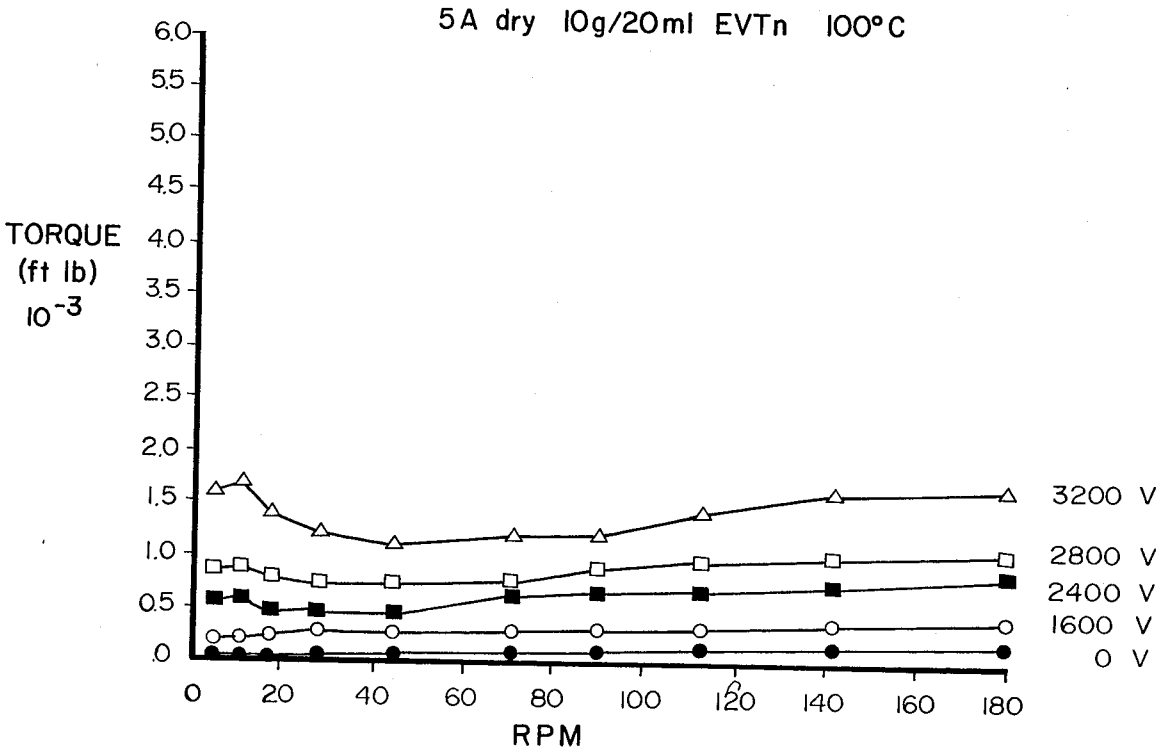
Figure 7:
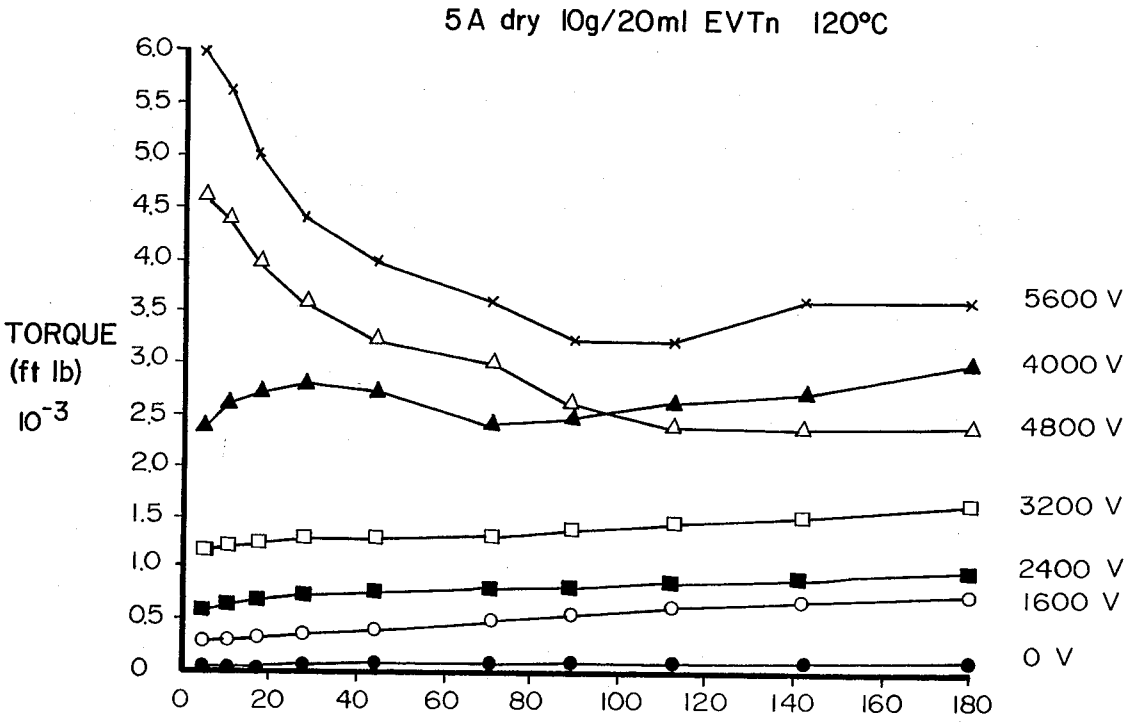
Figure 8:
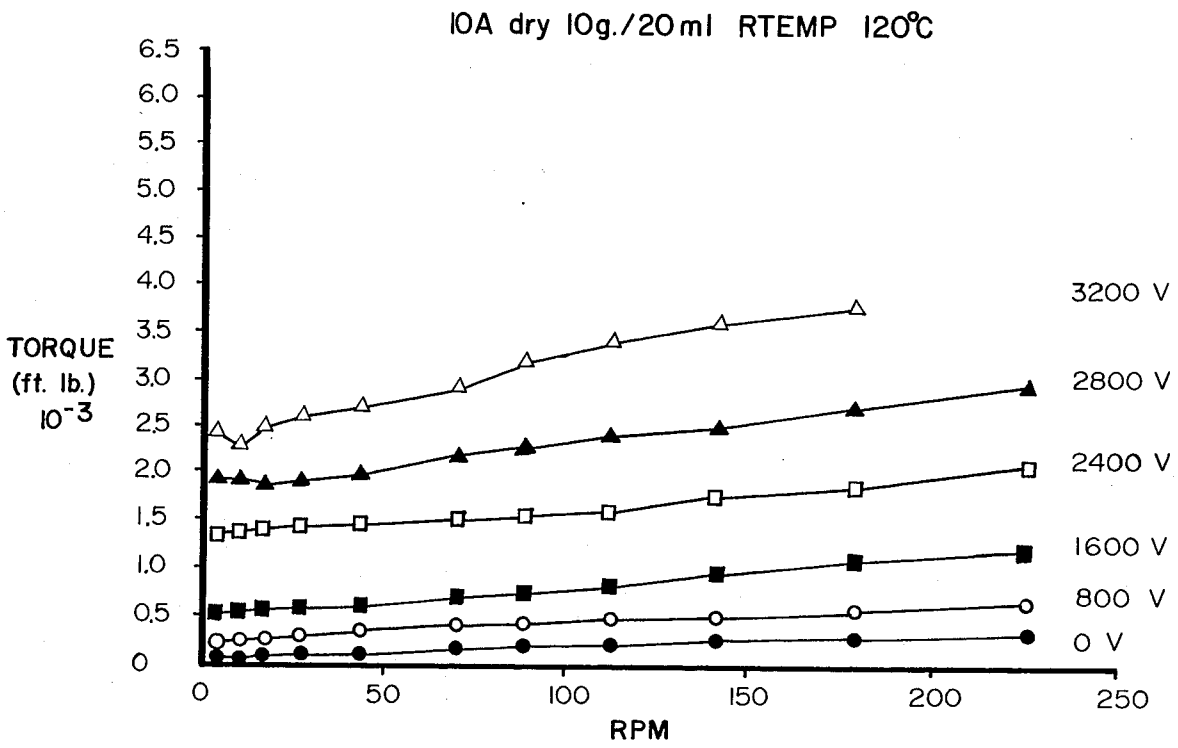

The following Examples I through VIIII summarize the details of the individual fluids being measured and the conditions under which the measurements were performed. The corresponding FIGS. 1 through 8 present the resulting data for the respective Examples as plots of measured or observed torque as a function of rpm at various applied electric field strengths.

EXAMPLE I

Particulate Phase: potassium sodium aluminosilicate supplied by Sigma Chemicals, normals pore diameter 3A; article diameter <10; nominal starting water capacity 23% by weight; characterized by the formula:

$$K_9Na_3[(AlO_2)_{12}(SiO_2)_{12}]27H_2O$$

(dried at 250 C. for a sustained period of time).

Liquid Phase: high dielectric hydrocarbon oil supplied by RTE Corp. under the tradename EVTn.

Concentration: 10 grams of dried particulate phase per 20 ml liquid phase.

Temperature: 100 C.

EXAMPLE II

Particulate Phase: same as Example I.

Liquid Phase: same as Example I.

Concentration: same as Example I.

Temperature: 120 C.

EXAMPLE III

Particulate Phase: same as Example I.

Liquid Phase: high dielectric hydrocarbon oil supplied by RTE Corp. under the tradename RTEMP.

Concentration: same as Example I.

Temperature: 120 C.

EXAMPLE IV

Particulate Phase: sodium aluminosilicate supplied by Sigma Chemicals, nominal pore diameter 4A; particle diameter <10; nominal starting water capacity 28% by weight.

Liquid Phase: same as Example I.

Concentration: same as Example I.

Temperature: 100 C.

EXAMPLE V

Particulate Phase: same as Example IV.

Liquid Phase: same as Example III.

Concentration: 16 grams dried particulate phase per 20 ml of liquid phase.

Temperature: 100 C.

EXAMPLE VI

Particulate Phase: calcium sodium aluminosilicate supplied by Sigma Chemicals, nominal pore diameter 5A; particular diameter ,10 ; nominal starting water capacity 28% by weight; characterized by the formula:

$$Ca_{4.5}Na_3(AlO_2)_{12}(SiO_2)_{12}]30H_2O$$

(dried at 250 C. for a sustained period of time).

Liquid Phase: same as Example I.

Concentration: same as Example I.

Temperature: 100 C.

EXAMPLE VII

Particulate Phase: same as Example VI.

Liquid Phase: same as Example I.

Concentration: same as Example I.

Temperature: 100 C.

EXAMPLE VIII

Particulate Phase: sodium aluminosilicate supplied by Sigma Chemicals, nominal pore diameter 10A; particle diameter <10; nominal starting water capacity approximately 34% by weight; characterized by the formula:

$$Na_{86}[(AlO_2)_{86}(SiO_2)_{106}]264H_2O$$

(dried at 250 C. for a sustained period of time).

Liquid Phase: same as Example III.

Concentration: same as Example I.

Temperature: 120 C.

As can be seen in FIGS. 1 through 8, all of the above Examples exhibited the desired electric field dependency; (i.e., significant apparent viscosity in the presence of an electric field) at temperatures of 100 C. and higher even at high shear rate conditions. As such, the data confirm the effacy of the compositions according to the present invention. Further, no significant release or evolution of water was observed and the viscosities immediately drop upon cessation of the applied electric field. Similar high temperature electroviscous properties have been observed and measured under low shear conditions for systems similar to the above Examples including silicone oils as well as high dielectric hydrocarbon oils as the liquid phase.

The improved electric field dependent fluids according to the present invention can be used in any electroviscous or electrorheological application as generally known in the art. The electric field dependent fluids of the present invention can be used as alternatives to friction clutches and torque converters for coupling engines or motors to transmissions or other types of machinery, for valves and solenoids, and as alternatives to friction brakes. As torque transfer media, the fluids have the distinct advantage of being able to control speed without varying the speed of the engine; being electrically controlled, they allow the direct control of torque transfer or speed with computers. As braking media, they eliminate problems with uneven braking and brake lock up by again allowing computers to control the extent of braking at separate wheels. In torque transmission from turbine engines, speed can be varied while allowing the turbine to continue operating at optimum power and efficient rpm. The compositions of the present invention are viewed as being particularly useful in that they are stable and operable at temperatures well over 100 C. and at least as high as 120 C. or even higher. They have also been shown to be operable at these high temperatures under high shear rates.

Having thus described and exemplified the preferred embodiments with a certain degree of particularity, it is to be understood that the invention is not to be limited by the embodiments set forth herein for purposes of exemplification, but is to be limited only by the scope of the attached claims, including a full range of equivalents to which each element thereof is entitled.

We claim:

1. An electric field dependent fluid comprising:

(a) a nonconductive liquid phase; and (b) a dispersed particulate crystalline zeolite phase, substantially free of adsorbed water.

2. An electric field dependent fluid of claim 1 wherein said crystalline zeolite is characterized by the formula: $M_{(x/n)}[(AlO_2)_x(SiO_2)_y.wH_2O$ where M is a metal cation or mixture of metal cations of average valence charge n, x and y are integers and the ratio of y to x is from about 1 to about 5, and w is a variable.

3. An electric field dependent fluid of claim 2 wherein said fluid exhibits significant viscosity dependence upon an imposed electric field at temperatures is excess of 100 C. without releasing significant amounts of water.

4. An electric field dependent fluid of claim 2 wherein said fluid exhibits significant viscosity dependence upon a imposed electric field at temperatures in excess of 120 C. without releasing significant amounts of water.

5. A method of preparing a field dependent fluid adapted to be operative at temperatures in excess of the boiling point of water without the release of water comprising the steps of:

(a) selecting a nonconductive liquid of said field dependent fluid;

(b) selecting a particulate crystalline zeolite of said field dependent fluid: and (c) subjecting said nonconductive liquid and said particulate crystalline zeolite to a temperature in excess of the temperature to which the field dependent fluid will be subjected to during use for a sufficient time to degas and remove water.

6. A method of claim 5 wherein said crystalline zeolite is characterized by the formula: $M_{(x/n)}[(AlO_2)_x(SiO_2)_y wH_2O$ where M is a metal cation or mixture of metal cations of average valence charge n, x and y are integers and the ratio of y to x is from about 1 to about 5, and w is a variable.

7. A method of claim 6 further comprising the steps of combining said nonconductive fluid with said particulate crystalline zeolite before subjecting said combination to a temperature in excess of the temperature to which the field dependent fluid will be subjected to during use for sufficient time to degas and remove water from said combination.

8. A method of claim 7 wherein said temperature for degassing and removing water is performed at from about 250 C. to about 350 C. under vacuum.

* * * * *